US010555876B1

(12) United States Patent
Samandari

(10) Patent No.: US 10,555,876 B1
(45) Date of Patent: Feb. 11, 2020

(54) PACIFIER WITH CLEANING BRUSH

(71) Applicant: Nafys Samandari, Scottsdale, AZ (US)

(72) Inventor: Nafys Samandari, Scottsdale, AZ (US)

( * ) Notice: Subject to any disclaimer, the term of this patent is extended or adjusted under 35 U.S.C. 154(b) by 0 days.

(21) Appl. No.: 16/383,223

(22) Filed: Apr. 12, 2019

(51) Int. Cl.
*A61J 17/00* (2006.01)

(52) U.S. Cl.
CPC ..... *A61J 17/001* (2015.05); *A61J 17/008* (2015.05)

(58) Field of Classification Search
CPC ..... A46B 2200/1066; A46B 15/0055; A46B 9/005; A46B 9/026; A46B 9/02; A46B 9/028; A61J 17/001; A61J 17/006; A61J 17/02; A61J 17/00; A61H 13/00
See application file for complete search history.

(56) References Cited

U.S. PATENT DOCUMENTS

| | | | | |
|---|---|---|---|---|
| 4,115,893 | A | 9/1978 | Nakata et al. | |
| 5,711,759 | A | 1/1998 | Smith et al. | |
| 6,602,013 | B2 | 8/2003 | Clark | |
| 6,769,828 | B2 | 8/2004 | Clark | |
| 7,144,416 | B2 | 12/2006 | Struckmeier et al. | |
| 8,211,144 | B2 | 7/2012 | Rohrig | |
| 2001/0029324 | A1* | 10/2001 | Walker | A61B 5/14552 600/323 |
| 2007/0208380 | A1 | 9/2007 | Ebner | |
| 2011/0046671 | A1* | 2/2011 | Okoturo | A61J 7/0053 606/236 |
| 2012/0053632 | A1 | 3/2012 | Tirosh | |
| 2013/0304121 | A1* | 11/2013 | Hakim | A61J 17/02 606/235 |
| 2017/0151131 | A1 | 6/2017 | Bawa | |

FOREIGN PATENT DOCUMENTS

| | | | |
|---|---|---|---|
| KR | 2014-0141944 | * 12/2014 | |
| WO | WO-2011092706 A1 * | 8/2011 | A61J 11/007 |

OTHER PUBLICATIONS

Machine translation for KR 10-2014-0141944 published Dec. 11, 2014 (Year: 2014).*

* cited by examiner

*Primary Examiner* — Katherine M Shi
(74) *Attorney, Agent, or Firm* — Bycer Law, PLC; Matthew L. Bycer

(57) ABSTRACT

A hygienic oral pacification device includes a fluid-filled bladder. The bladder includes a nipple and alveolar ridge-mating flanges. The bladder is dynamically shaped and allows for pressures provided by the suckling child to re-shaping the bladder and flanges. A bite-block extends into the bladder to maintain a fluid path from nipple to flanges. As the child completes the suckling cycle, the bladder nipple is depressed and fluid is forced in the engorging flanges. The flanges thus cover the alveolar ridges and fill the vestibules. The flanges may be covered with a textured surface, or bristles, that provide mechanical brushing of oral surfaces. Denitrifies may be applied over the bristles to enhance cleaning.

31 Claims, 9 Drawing Sheets

Checkprint

TITLE: Pacifier
ATTORNEY DOCKET: 9118

7/9

PACIFIER WITH CLEANING BRUSH

BACKGROUND OF THE INVENTION

1. Field of the Invention

The present invention relates to the general art of oral hygiene. The present invention more particularly relates to a pediatric dental oral hygiene device and use thereof.

2. Description of Related Prior Art

Children from the age of zero to two years commonly use oral apparati, such as pacifiers, for numerous purposes. As may be understood from the name "pacifier", the tool may be used to calm or sedate a child. Additionally, the tool may be used to exercise a child's tongue and cheek muscles, and otherwise serve to clean interior surfaces of the oral cavity via friction provided by the pacifier exterior surface(s). While newborns are often born without any erupted teeth, up to 15% of newborns in the United States have one or more teeth present. The "baby" tooth or teeth may be compromised due to decay caused by bacterial metabolic byproducts produced from substances in the oral cavity such as sugars present in milk, formula, or otherwise the tooth/teeth may be susceptible to damage from bacterial and fungal biofilms that may develop on the oral surfaces. It is therefore advantageous to include an oral apparatus that acts to clean, or otherwise brush, the upper and lower gingival ridges and/or erupted teeth. In addition, it has been shown that in the year 2014, approximately 40% of children under the age of 5 have some evidence of caries, often referred to as baby bottle caries.

Most oral apparati, such as pacifiers, binkies, soothies, etc., are often symmetrical. Oftentimes, a binky, or surrogate nipple, may be uniformly isometric, such as including a cylindrical nub with hemispherical cap (imitating a mother's biological nipple). Advanced oral devices may be transversely symmetrical, left to right, however, may include longitudinal shape changes such as alternating superior and inferior sides to better mimic the shape and location of the tongue, and the slight overbite of a baby, newborn, infant, or toddler. The promotion of an ideal orthotopic development of the maxillary and mandibular arches leads to the better development of the airway spaces, and this contributes to the prevention of multiple chronic maladies. As known in the field of orthotropics, deficiencies in airway spaces exacerbate these chronic conditions.

Prior attempts have been made to provide oral devices that achieve the dual purpose of pacification and oral hygiene, however, they suffer the drawbacks of improperly accounting for the changing shape of the mouth during the suckling exercise.

It is therefore a primary object of the present invention to provide an oral hygiene device that provides for friction activated cleansing of interior oral surfaces.

It is another object of the present invention to provide a pacifier to mate with at least one of the superior or inferior ridges (gingival and/or tooth) for hygienic purposes.

It is yet another object of the present invention to foster proper development of the orthognathic relationship of the upper and lower jaw bones.

It is a further object of the present invention to provide an easy to use oral device useful for babies and/or small children.

These and other objects of the present invention will become apparent to those skilled in the art as the description thereof proceeds.

SUMMARY OF THE INVENTION

The present invention is directed to an oral pacification device adapted to be partially inserted into the oral cavity, with the shield set on the outer surface of the lips, and the nipple, with flanges/wings emplaced within. There are two components to the device—an extra-oral base piece and an intra-oral nipple. The intra-oral part includes a bladder formed within an exterior shell. The bladder includes an interior that is a fluid-filled chamber. The bladder forms the nipple that extends posteriorly with flanges/wings set on the bladder outer surface at the anterior end. It is contemplated that the flanges be set against the anterior surfaces of the alveolar ridge(s) and wings set posterior the ridges. The chamber has a passage opening from the nipple bulb and into the flanges/wings. Preferably the bladder is a single fluid filled chamber, but it may be sectioned. The shell of the bladder includes an outer surface that has surface features, such as a texture, fingers, bristles, etc. The textured surface may be set in direct contact with the ridges (either bare gums (edentulous), or with erupted teeth). In alternative embodiments, the textured surface may also extend along the inferior surface of the nipple and bulb to provide for cleaning of the top of the tongue, and along superior surface to clean the roof of the mouth/hard palate.

A bite block may be established in the bladder, and preferably extend to the bladder nipple bulb. In some embodiments, the bite block is set within and interacts with chamber. The bite block may be integrally joined with the exterior lip shield. The bite block preferably includes a bifurcated dual prong structure defining a channel set between the two prongs to allow flow of fluid within the bladder to pass between the flanges and the bulb.

Preferably, the bladder is made of a malleable shape-memory material preferably silicone or other material (as described below). The bladder should be malleable and transformed under pressure, but spring back into an original position when the pressures are released. The bladder is transformed by the pressure of the tongue thrust against the hard palate and laterally by the primary muscles of suckling, being the orbicularis oris and buccinators. Fluid is forced into the flanges, and the textured surface rubs and moves against the alveolar ridges and/or teeth to provide mechanical or frictional cleaning. The textured surface may also rub (or brush) labial and lingual surfaces. The product (flanges/wings and bristles) may be dipped into a dentifrice to facilitate additional cleansing with the friction action. The dentifrices have medicinal ingredients such as essential oils and vitamins for the betterment of oral health.

A second flange/wing may be set, wherein a top/superior flange is set forward (anterior) relative the lower/inferior flange/wing to promote proper orthognathic alignment of the jaw. The flanges and wings may provide a valley for emplacement of the alveolar ridge, and set a position of the device in the mouth relative the ridge(s). The bladder shell may be thicker at the bulb/nipple, and thinner along the flange(s) to facilitate easier expansion. A single circumferential flange/wing set may be used, and preferably a single flange/wing would be offset between top and bottom for orthognathic purposes. The flanges/wings are preferably softer and malleable to conform to the shape of the teeth/ ridges. The flanges/wings have a butterfly indented border to prevent impingement of the maxillary and mandibular frenums.

The present invention also refers to a pacifier adapted for hygenic maintenance of the oral cavity. A first separable base unit may include harder portions (of preferably plastic) including the lip shield and mounting locations, as well as an integrated bite block (that may include prongs and/or dowels) extending posteriorly into the oral cavity. A second separable bladder containment unit may include an open end, and be shaped to form the nipple and flange(s)/wing(s) with textured surface/bristles. An edge may be mated with the base (and secured thereto by using an adhesive, or other securing means known in the art) to form a fluid-tight seal around an inner chamber. The sealed bladder chamber may be filled with a fluid, such as air, gas, a composite liquid, water, gel, etc. Preferably, the chamber includes a continuous cavity extending into the nipple and flange(s). The bite block dowels extend into, and are surrounded by, the bladder. The bite block may include a bifurcated set of prongs to form a channel to allow fluid movement between the flanges and bulb.

The present invention may feature a two-piece unit with extra-oral base and intra-oral bladder. The intra-oral bladder portion preferably provides a malleable fluid-filled chamber extending into a nipple with bulb. When a freezable liquid is used, the liquid may be frozen to provide a hard and cold nipple bulb, and flange(s). The frozen pacifier may no longer include the dynamic shape-changing bladder, but may become a static-shaped teething tool to allow for teething. Alternatively, cooling or freezing the fluid may provide a less-dynamic, more resistant pacifier, as the bladder fluid becomes more viscous. The extra-oral base may include one or more posteriorly extending dowels or prongs to create a bite block that prevents occlusion of fluid passage with bladder between a nipple bulb and one or more expandable flanges. The intra-oral bladder may include a nipple and flange(s) for the movement of fluid from the bulb to engorge the flange(s). Furthermore, as the shape of the intra-oral section is modified by movement of fluid, a textured surface or bristles on the exterior of the shell cause mechanical brushing of the tissues. Natural dentifrices may be used on a textured surface or bristles. Preferably, the flange(s) is placed anterior to, and a second set of wings(s) are placed posterior to, the alveolar ridges thus enabling contact on all sides of the tooth bearing areas of the ridges. Given that the maxillary arch is often slightly anterior to the mandibular arch to create an ideal orthognathic relationship, this may be supported by a five to twenty-five degree angular variance from the maxilla to the mandible. Sometimes, the superior jaw is forward of the inferior jaw by approximately 3 mm, and the flanges may be offset accordingly. The textured surface or bristles may accentuate mechanical brushing. A butterfly shape of the flanges may allow for freedom of movement of the maxillary and mandibular frenums. A variety of sizes may be used for neonates, infants and toddlers, etc.

The present invention also includes a method of providing oral hygiene via a pacifier, such as the one described herein. The pacifier would include a textured outer surface. The pacifier is placed partially into the mouth. The pacifier should include a single-chambered fluid-filled bladder that forms a nipple and at least one flange/wing along the exterior of the bladder. The bladder should include exterior surface features such as the textured surface, bristles, etc. Once the pacifier is placed in the mouth, the lips are enclosed around the shall. The flanges/wings are positioned against the anterior/posterior surfaces of the alveolar ridges, such as the front of the alveolar ridge or incisor(s). In order to set the pacifier, the user may bite down on the bladder, and be prevented from cutting through the bladder by the supporting internal bite block (preferably made of more than one dowel or prong, of a material such as a hard plastic, rubber, etc.). The bite block should cause a channel to be formed through the bite block (between prongs) so as to allow fluid flow from nipple into the flange(s).

To use the dynamically shape-changing pacifier, the tongue thrusts against the hard palate, and/or the orbicularis oris (and buccinators) flex, causing external pressures on the nipple. These actions of the mouth also guide the reshaping of the bladder (with flanges/wings) to conform to the open space in the mouth so as to effect mechanical brushing along the alveolar ridge(s) and within the vestibule(s). The nipple is thereby compressed to force fluid from the bulb into the flange(s). The fluid flow causes the flange(s) to extend, and with them, the textured surface moves relative to the oral surface and cause mechanical cleaning of an oral surface. When the sucking is in tightest position, the flanges should extend to fill the vestibules, and/or reach up to and beyond the gingival crest of the tooth. As the sucking cycle concludes, the mouth relaxes and the pressure is released against the outside surface of the bladder. The fluid returns form the flanges (which then shrink) and the nipple bulb refills with fluid. When the textured surface is covered with a dentifrice, the complete sucking motion may cause the aided brushing of the oral tissue surfaces.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

Figure 1:
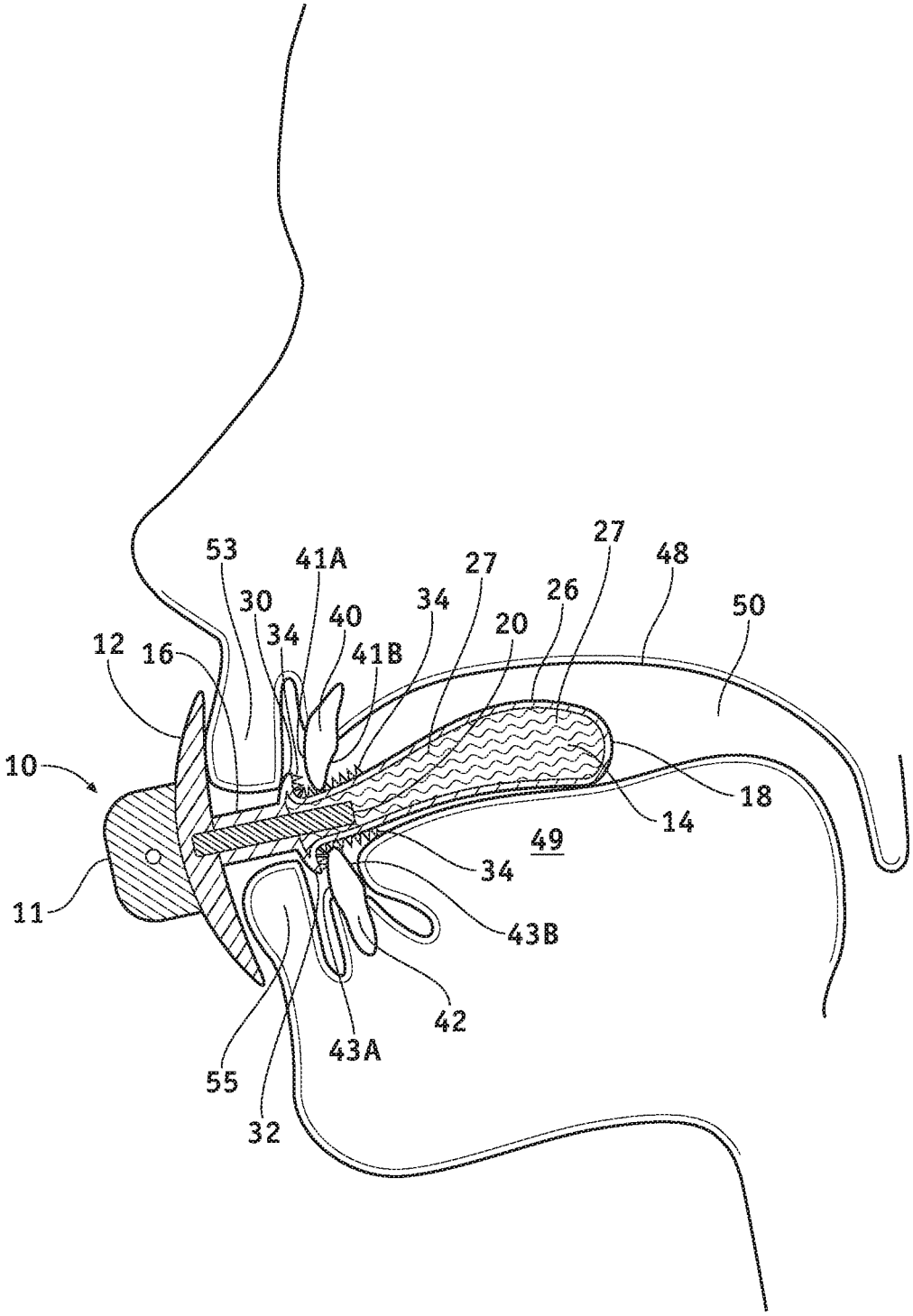
FIG. 1 illustrates a cross-sectional side view of a toddler's oral cavity in first position with an embodiment of the present invention applied.

The present invention is directed to an orthognathically corrected pacifier that serves multiple purposes. The device is orthognathically positioned to help nurture the jaws grow into a better alignment. The device may be made up of two separable, or joined parts: an extra-oral casing preferably of hard plastic, (which may include a bite block, the bite block fitting into) an intra-oral bladder, preferably made of an antibacterial material such as silicone. Preferably, the bladder material has shape-memory to revert to a resting position, and is further free of latex, BPA, and phthalate. The bladder may include a nipple and flange(s). Preferably, the size of the device is scalable to allow a variety of sizes (e.g. small, medium, large or neonatal, infant, toddler). Additionally, the relative size and positions of each feature may be modified to accommodate the changing shape of the human mouth as the child grows.

It is preferred that a single chamber is shared between the flange(s)/wing(s) and the nipple. However, a flexible wall or walls may separate the bladder into two or more chambers. The bladder may be filled with a fluid, such as air, gas, liquid, or a more viscous liquid or gel, so as to allow flanges/wings and nipple to modulate in size and shape based on pressure exerted by the position of various muscle movements of the user's oral cavity. Alternatively, the bladder may be filled with a flowing malleable solid or pressure-dependent solid, or may be a solid feature. It is contemplated that the fluid may be a freezable liquid that can be frozen to make the bladder hard (and cold) to provide a soothing effect, such as the relief of painful teething of erupting teeth. Used in its frozen state, as an appliance to soothe and relieve the very painful eruption of primary teeth, such as a teether, etc. freezing fluid solutions may include water with little to no soluble materials (e.g. salt, etc.).

Under standard operating protocols, the invention provides a method for maintaining oral hygiene. As suckling is conducted, the nipple may be compressed by external forces applied by the patient's oral muscles. The suckling motion causes the nipple to compress, and forces transfer of fluid to engorge the flanges. The flanges are therefore expanded. As the flanges engorge, the textured surface or bristles set on the outer surface of the bladder may contact, and move against (or brush), surfaces of the oral cavity. The textured surface and/or bristles may be of a rigid or softer material such as silicone to provide for the mechanical brushing of the ridges.

Additionally, dentifrices, such as emulsified creams or foams or gels, or tinctures, of oils, minerals, natural cleansers, soothing formulae, analgesics, etc. as may be known in the art to provide for improved oral care, may be provided as a dentifrice in, along, and between bristles or ridges. All age appropriate manner of dentifrices known in the art for oral care are contemplated for use on the textured exterior surface of the bladder. Essential oils (emulsified, diluted, or pure) are preferred, including peppermint, tea tree, lavender, eucalyptus, oregano, palma rosa, orange, lemongrass, geranium, citronella, etc. Alternatively toothpastes may be used, preferably without fluoride (so as to be safe for use with babies). Currently, many such products are available and useful, such as glycerin, water, silica, algin, calendula extract, prunus amygdalus dulcis oil, clove oil, esculin, limonene, benzocaine, belladonna, xylitol, WINK teething gel, Olea europaea oil, salix alba, eugenia caryophyllus flower oil, rebadiana leaf, mentha viridis leafoil, tocepherol, and many other suitable products as may be known in the art. The dentifrice is applied to the exterior surface of the flanges of the bladder, over and between the textured surface features, such as on and between the bristles.

In order to provide proper orthognathic alignment, the maxillary arch is advanced compared to the mandibular arch by approximately fifteen degrees to promote correct orthognathic growth development. Each arch serves as a flange for placement in front of the teeth and/or gingival ridges.

Referring now to FIG. 1, cross-section of a toddler's face and oral cavity is shown. Pacifier 10 is placed into the mouth with the shield 12 and mount 11 placed outside the cavity. Upper lip 53 and lower lip 55 fit around shaft 16 to hold pacifier 10 in place. Superior gum flange 30 and inferior flange 32 rest in front of teeth, such as superior incisors 40 and inferior incisors 42, thus facing superior incisor front 41A and inferior incisor front 43A. Teeth bite down on prongs 20, wherein prongs 20 serve as a bite block to prevent the user from biting through pacifier 10 or otherwise compromising fluid flow by occluding bladder 27. Bristles (or textured surfaces) 34 extend along flanges and further along nipple surface (top and bottom). Nipple 14 is provided to interact with tongue 49 and to be compressed against hard palate 48. Nipple is comprised of a bulb 18 with shell 26 (preferably silicone or like material) surrounding an inferior bladder 27 filled with air, inert gas, liquid water, viscous fluid, gel, or otherwise. Bladder extends from nipple into flanges.

Figure 2:
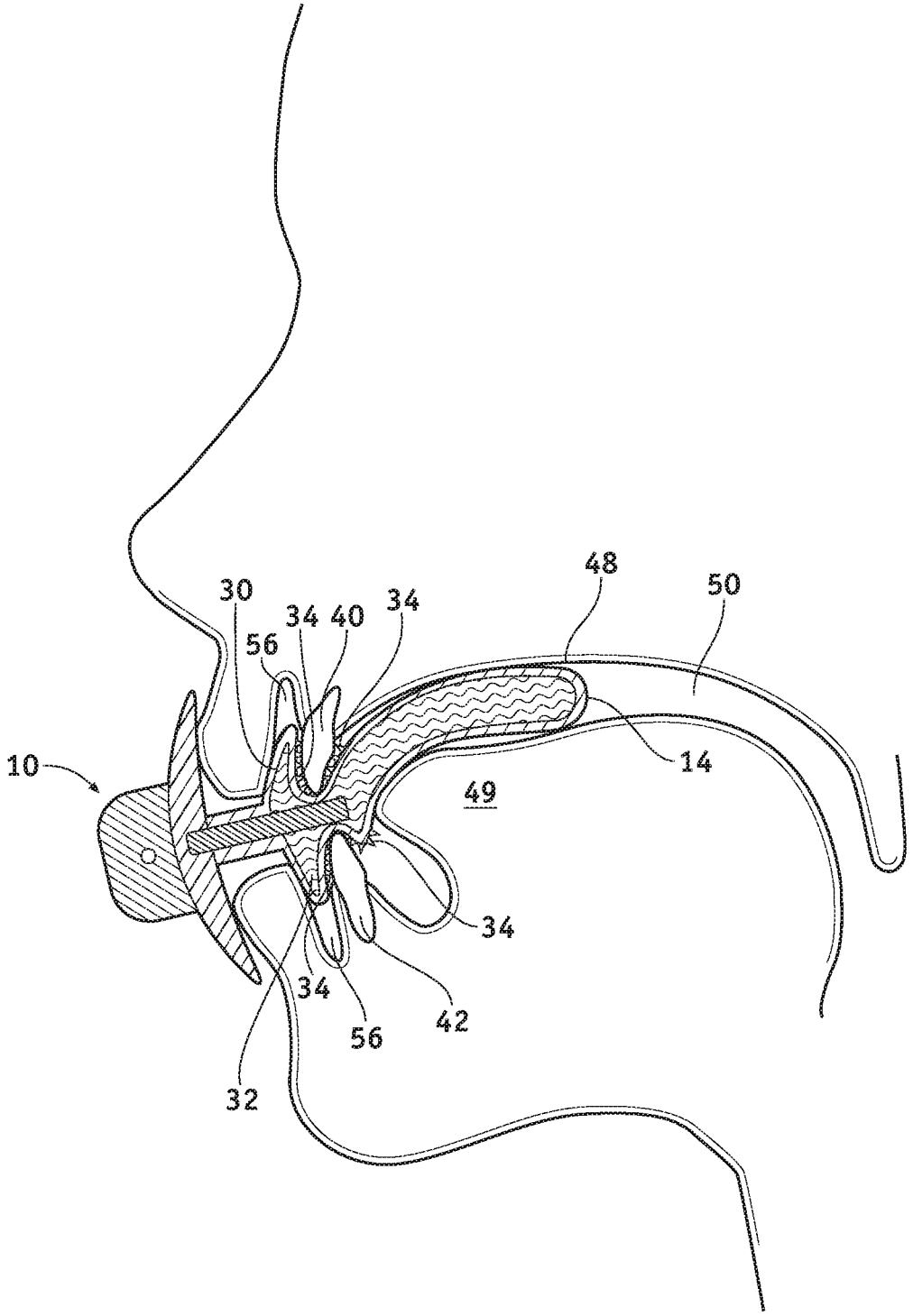
FIG. 2 illustrates a cross-sectional side view a toddler's oral cavity in second position with an embodiment of the present invention applied.

Moving from first position as shown in FIG. 1 to second position as shown in FIG. 2, the toddler begins the suckling motion in mouth cavity 50. Tongue 49 depresses against lower side of nipple to force nipple against hard palate 48. As tongue presses against nipple 14, exterior forces provided by the oral musculature provide higher pressure on nipple and bladder, thus forcing the fluid into superior and inferior flanges 30 and 32. Superior and inferior flanges 30 and 32 engorge and fill user's vestibule 56 to the front of superior and inferior incisors 40 and 42. As flanges expand, bristles 34 are forced along tooth surface and therefore provide mechanical cleaning of tooth surfaces. Additionally, bristles 34 may extend further on to nipple (not shown) so as to provide cleaning of the rear gum, hard palate, and tongue. In some embodiments, bristles may extend over the entirety of bladder surface.

Figure 3:
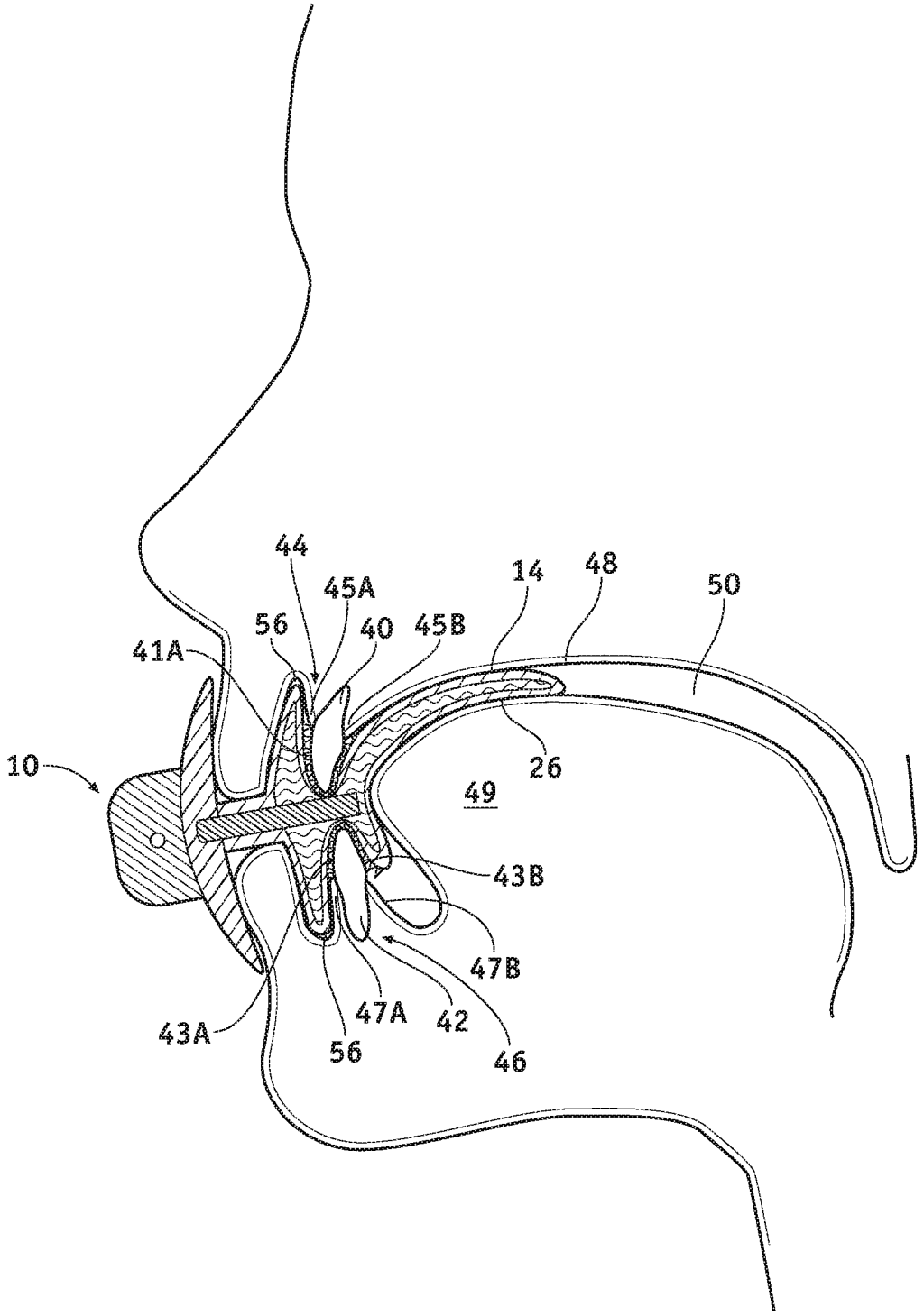
FIG. 3 illustrates a cross-sectional side view of a toddler's oral cavity in third position with an embodiment of the present invention applied.

As seen in FIG. 3, suckling motion is at maximum. Toddler oral cavity 50 moves into third position. User's tongue provides a higher pressure pressing nipple 14 between tongue 49 and hard palate 48. With this pressure, fluid in the bladder migrates to flanges, and the bladder is forced to change shape to fill both upper and lower vestibules 56 and mate with forward and rear surfaces of teeth 40 and 42. Additionally, bristles on bladder outer surface brush up against the gingival ridges 44 and 46. It is contemplated that in third position, bristled portions of bladder extend over superior gingiva forward surface 45A, superior incisors 40 and front 41A, superior gingiva rear surface 45B of superior gingivae 44, as well as on the lower jaw to cover inferior incisors 42 in both front and back 43A and 43B, as well as inferior gingivae 46 in front and back 47A and 47B. Tongue 49 depresses against nipple 14 to almost completely evacuate nipple section of the bladder. Interior surfaces of shell 26 may resist sticking to one another when nipple bladder is completely exhausted. It is contemplated that nipple will spring back to memory position and resume the shape of first position once the muscular forces have been removed.

Figure 4:
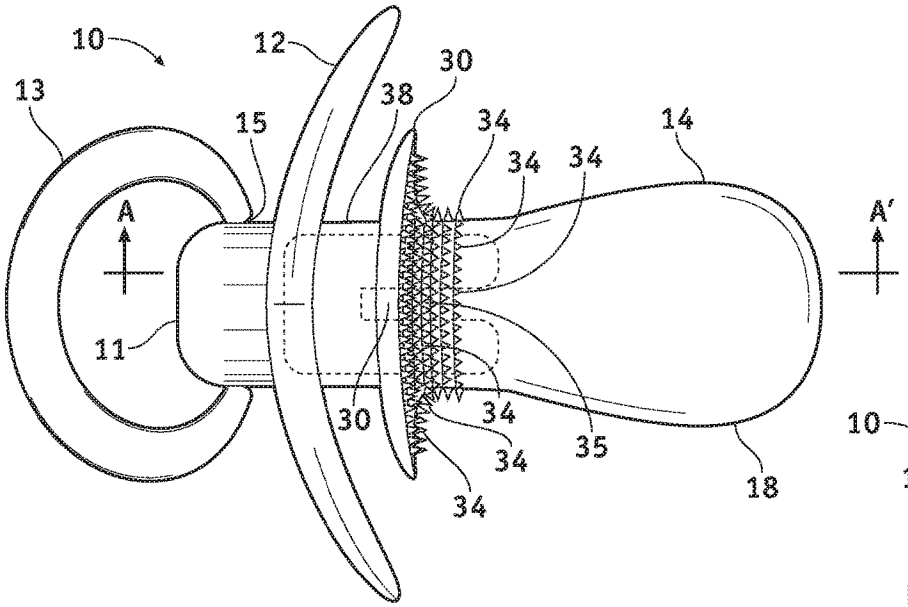
FIG. 4 illustrates a top view of an embodiment of the present invention.

As shown in FIG. 4, a top view of the pacifier 10 of an embodiment of the present invention is shown. Handle 13 fits onto mount 11, preferably in a rotatable fashion, through tunnel 15. A shield 12 is provided to cover the front of the lips. Superior gum flange 30 is provided to initially set in front of the superior incisors. Teeth bite down onto bristles 34 at bristled section 35 against bite block 38 shown as an interior portion of the product that would not be viewable unless transparent materials are used. Nipple 14 extends with bulb 18 as is known in the art.

Figure 5:
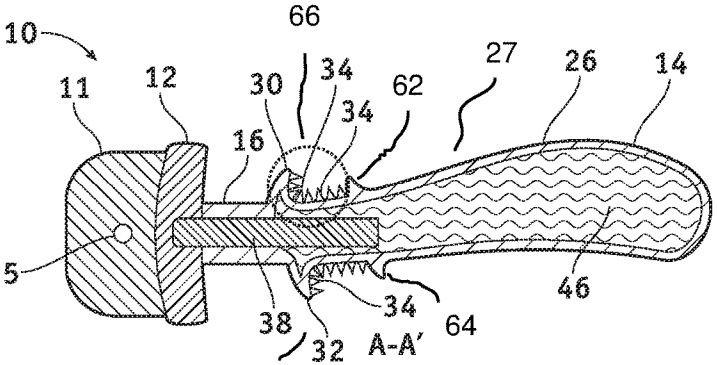
FIG. 5 illustrates a cross-sectional side view of an embodiment of the present invention.
Figure 6:
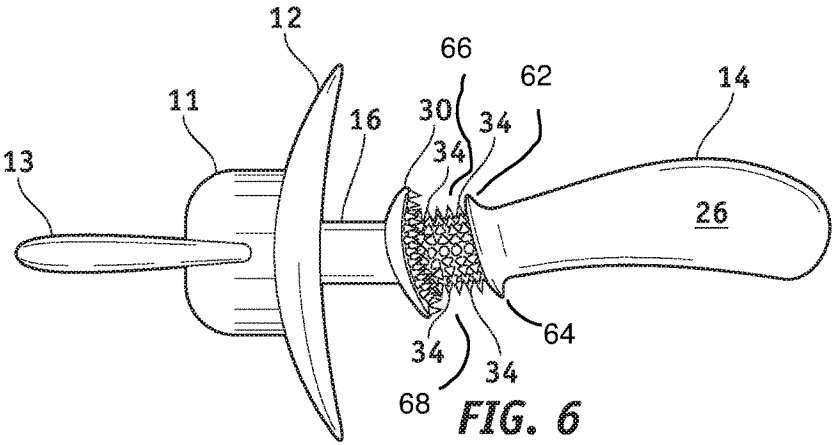
FIG. 6 illustrates a side view of an embodiment of the present invention.

As shown in FIGS. 5 and 6, side views of the apparatus demonstrate further aspects of the present invention. Again, pacifier 10 includes handle 13 mounted onto mount 11 through tunnel 15. Shield 12 is not intended for insertion into the oral cavity. Bite block 38 is formed to prevent teeth or gums from biting down on through or otherwise impeding movement of fluid within bladder. Shield and exterior portions of the pacifier mate with the nipple bladder via shaft 16. Superior gum flange 30 is set slightly forward of inferior gum flange 32 by approximately fifteen degrees to provide for proper orthognathic positioning of the jaw. The offset may be as little as zero to five degrees, or as much as forty-five degrees, depending mostly on the thickness of the nipple and/or bite block, and the age/development of the child user.

Bristles 34 extend onto flanges and onto nipple 14. Fluid 46 is shown within shell 26 as may be forced into flanges and otherwise to change the shape of nipple. It is preferred that the shape and dimensions of the flanges accommodate orthognathic placement of the alveolar ridges.

For illustrative and general relative proportional understanding, a model size is hereby discussed. It is contemplated that in a preferred model size, the superior flanges will be set approximately 3 mm anterior of similarly shaped inferior flanges. Flanges may be set roughly transversely extending from the nipple bulb approximately 3 mm, with the longitudinal bulb approximately 4 cm long. The textured area, including the bristles or fingers, may be as extend along nipple and one or both sides of flanges for as much as 1 cm (when stretched out longitudinally), to cover the teeth and reach the gums. The lip shield may include a transverse diameter of as much as 8 cm. The shield may be as thin as 5 mm, and may be the bite block 5 mm high. The prongs of the bite block may be set apart 8 mm (infant), 1 cm (toddler), and 1.5 cm (older child) to create the fluid channel.

As can be seen in FIGS. 5 and 6, the shape of the nipple 14 may not be completely round and symmetrical, but in some embodiments may include a differing upper and lower section. It is helpful to have a shaped flange to provide for proper alignment of upper and lower section to ensure that the orthognathic nature of the present invention is properly aligned with the front jaw forward and lower jaw rear by approximately 3 mm, ranging widely 1 mm to 7 mm, or ranging narrowly 2.5 mm to 4 mm.

Bladder shell may include one or more wings, or a circumferential wing (as shown in FIG. 6) along outer surface of shell. Upper wing 62 and lower wing 64 are preferably placed posterior of superior flange 30 and inferior flange 32, respectively, to form superior valley 66 and inferior valley 68, respectively. Superior valley 66 provides for a space to allow superior alveolar ridge to set in proper place along bladder surface. Similarly, inferior valley 68 provides for a space to allow inferior alveolar ridge to set in proper place along bladder surface. In this way, proper positioning of the ridges, and the jaw can be assured. Furthermore, wings may be hollowed (not shown) and share the common chamber as the flanges shown, wherein the wings may also expand to fill the vestibule upon sucking. Otherwise, the wings are meant to be smaller (or extend less) than the flanges so that when bristle surface 35 of bladder 27 extends into vestibule, the wings do not interfere.

Figure 7A:
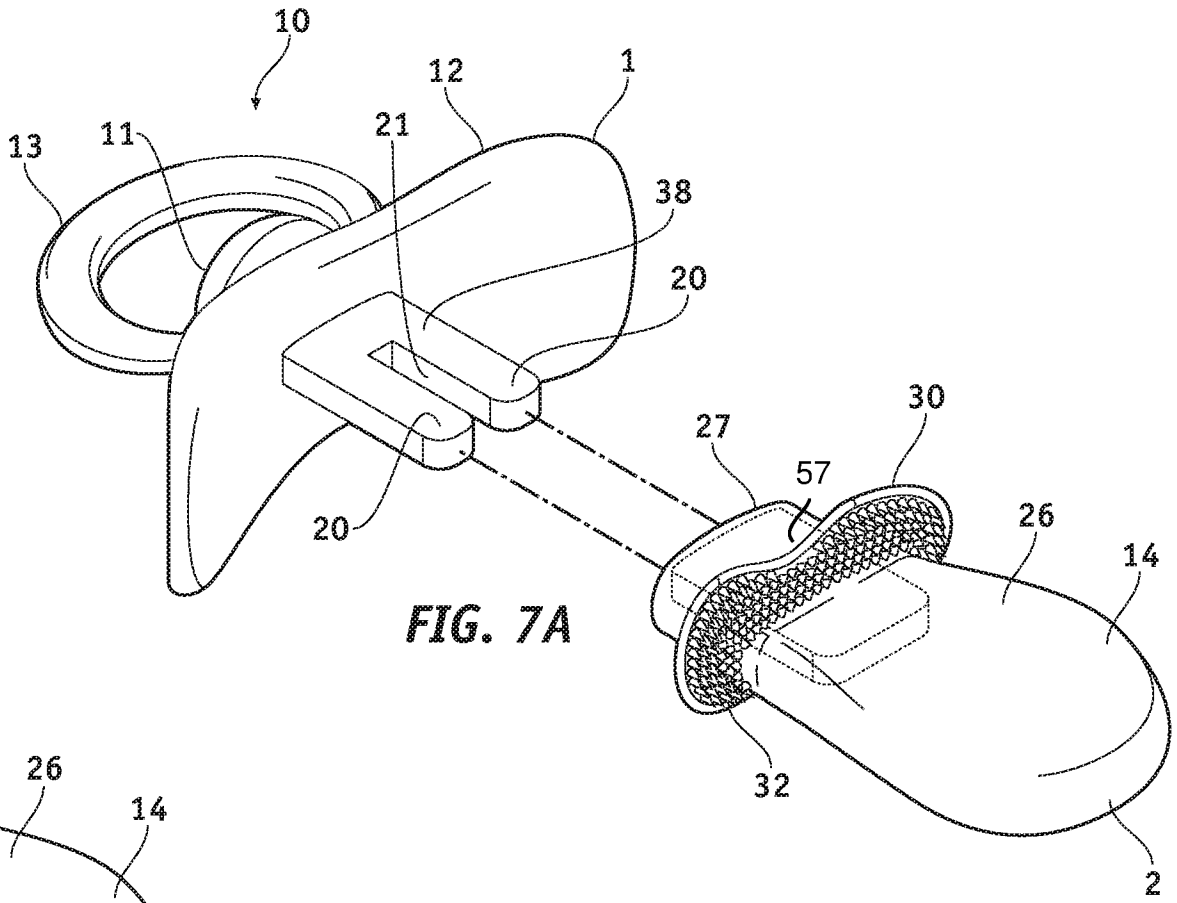
FIG. 7A illustrates an exploded perspective view of an embodiment of the present invention.
Figure 7B:
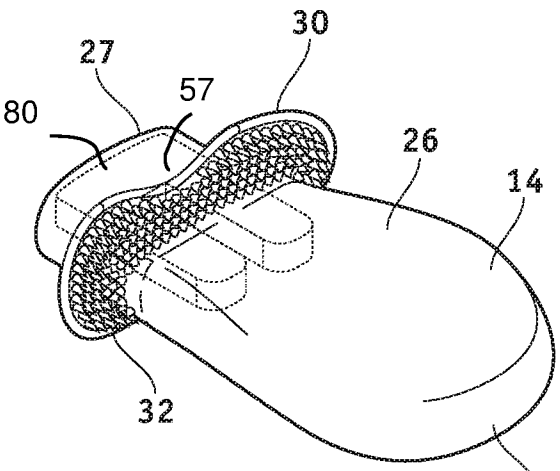
FIG. 7B illustrates a detachable nipple section of an alternative embodiment of the present invention.

As seen in FIG. 7, in one embodiment, the present invention includes two separable pieces. Two independent pieces may be attached to provide a functional unit. A first extra-oral piece, or base portion 1, and a second intra-oral nipple portion 2. The nipple portion may form a bladder with an open end to be affixed to the base portion to provide a seal. Alternatively, the nipple portion may form a complete continuous shell to provide a sealed bladder, the nipple portion including one or more cavity(ies) 80 (or recess on flat facing mating surface) for the emplacement of the bite block.

The first piece, or base portion 1, includes handle 13, mount 11, shield 12, and prongs 20 of bite block 38. Base portion 1 may include a hollow portion (filled with air), such as shaft and lip shield, for comfort. Prongs 20 form the bite block 38 and have channel 21 set therebetween. Channel allows for bladder to fit over prongs and allow movement of fluids into flanges. In this way, when the child bites down on the device, a channel is formed to allow fluid to flow anteriorly within bladder from the nipple into the flanges. Flanges may include upper indent 57 and lower indent (not shown) centrally positioned on flange ridge to accommodate a frenulum. The nipple portion 2 includes a bladder 27 that is formed by shell 26. Bladder provides both nipple 14 and flanges 30 and 32. It is contemplated that the device may include a nipple portion that is completely sealed. In an alternative embodiment, when base portion 1 and nipple portion 2 are combined and mated, the nipple portion 2 will be filled with the fluid and sealed against base portion 1 thereby enclosing the fluid in the reservoir.

Figure 8:
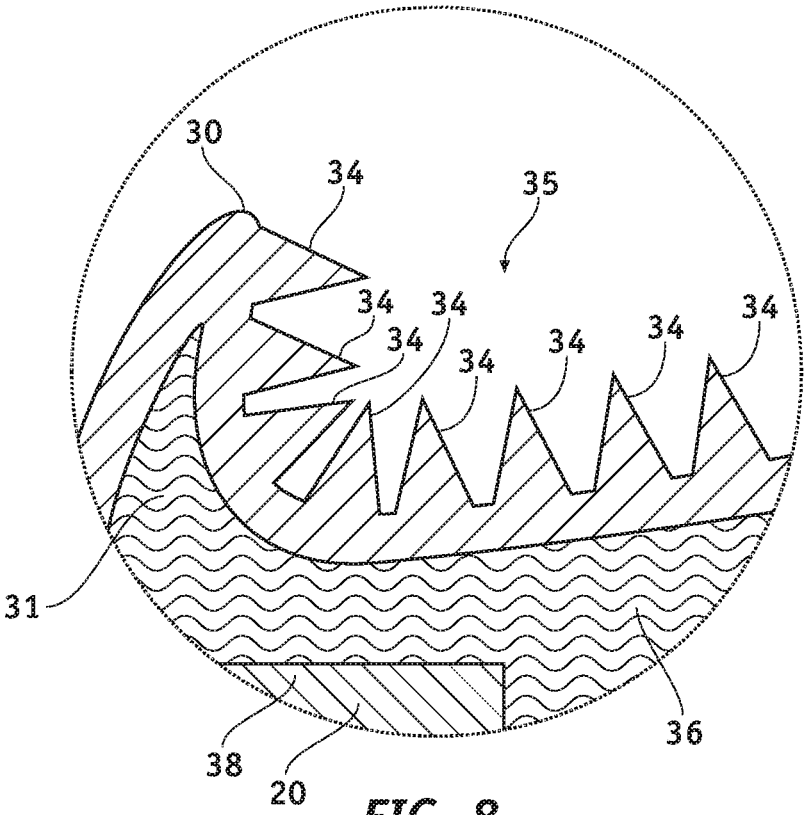
FIG. 8 illustrates a close-up cross-sectional side view of circle AA of embodiment as shown in FIG. 5.

FIG. 8 demonstrates a close-up of lines A-A' in FIG. 5. As can be seen, bladder 27 is filled with a viscous fluid 36. Shell 26 includes a bristle section 35 with bristles 34. Bristles may be of a variety of shapes, including sharp and triangular ridges, nubs, tubular, conical, hemispherical bumps, rounded ridges, pyramids, etc. as may be known in the art to provide for friction against an interior surface of an oral cavity. Such bristles or bristle section makes up surface features useful for mechanical brushing of oral tissues. Between various sizes of the product(s), bristles may be shorter for neonates without teeth, and longer for older children with erupted teeth. Superior gum flange 30 includes a filled portion 31 that is filled with fluid 36 shared between bladder in nipple and bladder in flanges. Bite block 38 is provided by prong 20.

Figure 9A:
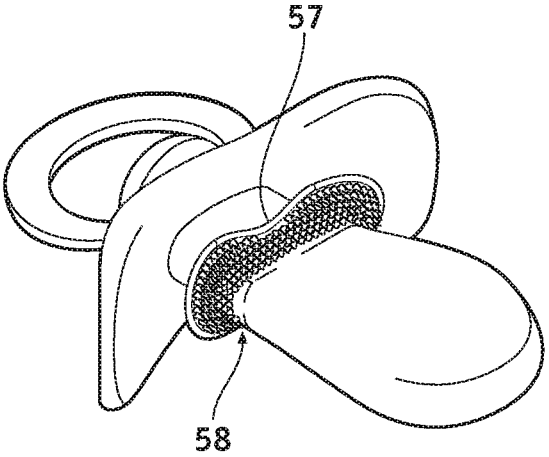
FIG. 9A illustrates a frontal view of an embodiment of the present invention in first position.
Figure 9B:
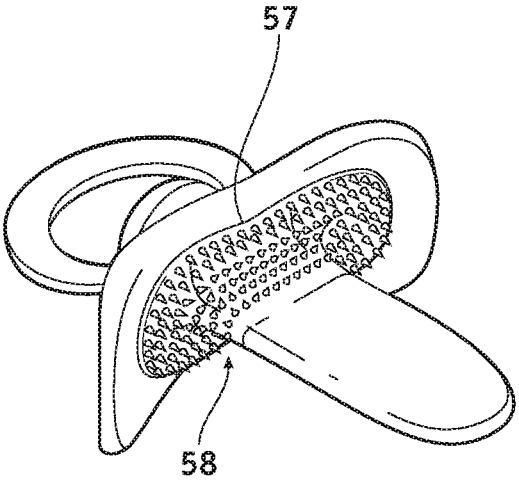
FIG. 9B illustrates a frontal view of an embodiment of the present invention in third position.

As can be seen in FIGS. 9A and 9B, the nipple bulb 18, shield 12, and flanges 30 and 32 are shown. In this embodiment, superior and inferior flanges form an entire circumferential fill around shaft 16. In an alternative embodiment, superior and inferior flanges are separable. Bristle section 35 is shown. In FIG. 9A, first position, bulb is filled with fluid. Moving to third position as shown in FIG. 9B, nipple bulb 18 is depressed and compressed providing an extension of bristles and bristle section towards flanges 30 and 32. As can be seen, superior gum flange 30 and inferior gum flange 32 include upper indent 57 and lower indent 58 to accommodate for superior labial frenulum and inferior labial frenulum, respectively.

Figure 10:
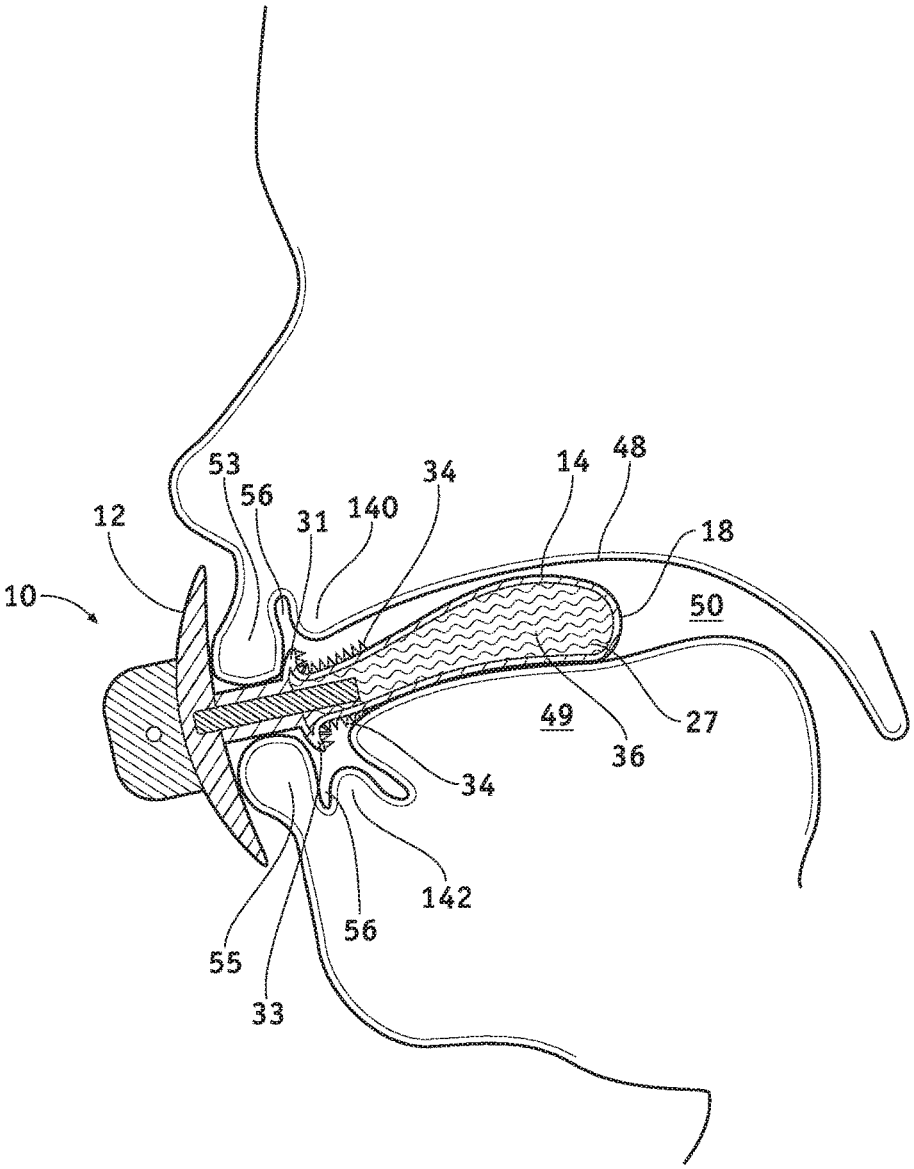
FIG. 10 illustrates a cross-sectional side view of a newborn's oral cavity in first position with an embodiment of the present invention applied.
Figure 11:
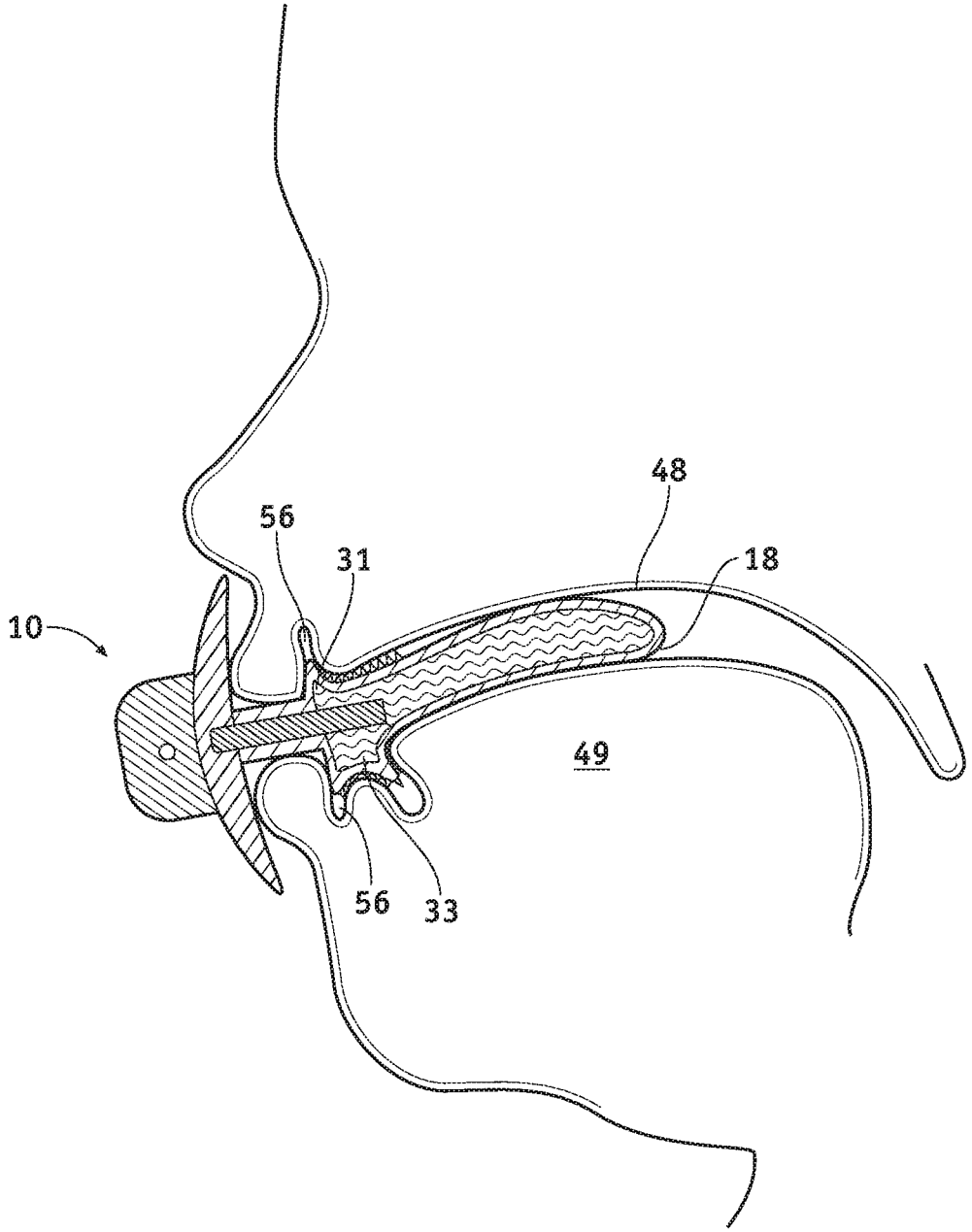
FIG. 11 illustrates a cross-sectional side view of a newborn's oral cavity in second position with an embodiment of the present invention applied.
Figure 12:
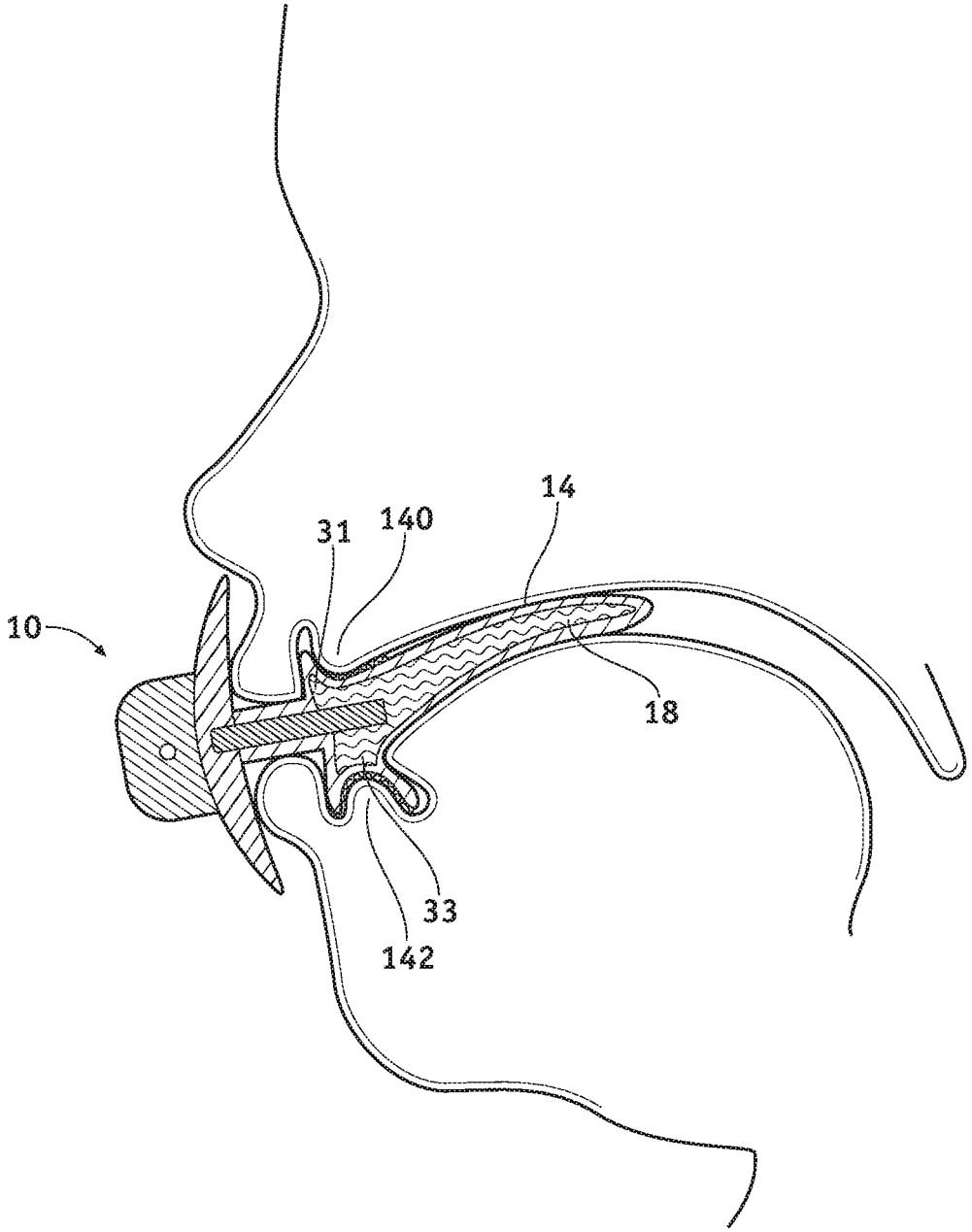
FIG. 12 illustrates a cross-sectional side view of a newborn's oral cavity in third position with an embodiment of the present invention applied.

As can be seen in FIGS. 10, 11, and 12 a new born in first, second, and third position, respectively is shown. Pacifier 10 is placed partially into oral cavity 50, with shield 12, or lip guard, set against upper lip 53 and lower lip 55. Newborn lips are known to be shorter than developed lips and enlarge as the child grows. The incisors, having yet to emerge, are confined within superior ridge 140 and inferior ridge 142. Bristles 34 can be set against the ridges 140 and 142 to provide for massaging or otherwise frictional cleaning of the gingival surface along the ridges. Similarly, as the suckling commences, the mouth mimics a set of feeding postures. As the tongue 49 depresses nipple 14 against hard palate 48, fluid 36 is forced in bladder 27 from bulb 18 into flange filled portions 31 and 33 of the superior 30 and inferior 32 flanges. The vestibules 56 are thus filled with the flanges to provide for frictional cleaning of oral surfaces.

I claim:

1. An oral pacification device adapted to be at least partially inserted into the oral cavity, said device comprising:

a. a bladder comprising an exterior shell and a fluid-filled chamber, the bladder forming a nipple at a posterior end and an at least first flange along an anterior end;

b. said chamber extending into said nipple and said at least first flange, a nipple interior in fluid communication with a flange interior, and c. a bite block set within said bladder; said bite block comprising at least two prongs.

2. The oral pacification device as set forth in claim 1 wherein said at least two prongs are bifurcated to form a channel therebetween and within said chamber.

3. The oral pacification device of claim 1 wherein said shell comprising secured surface features on an exterior surface of said shell.

4. The oral pacification device of claim 3 further comprising a dentifrice applied over said surface features.

5. An oral pacification device adapted to be at least partially inserted into the oral cavity, said device comprising:

a. a bladder comprising an exterior shell and a fluid-filled chamber, the bladder forming a nipple at a posterior end and an at least first flange along an anterior end;

b. said chamber extending into said nipple and said at least first flange, a nipple interior in fluid communication with a flange interior, c. an at least second flange, wherein said at least first flange comprises a superior flange on a superior side of said bladder, and said at least second flange comprises an inferior flange on an inferior side of said bladder, and wherein said superior flange is set anterior relative to said inferior flange;

d. wherein said at least first flange is set approximately 3 mm anterior relative at least second flange.

6. The oral pacification device of claim 5 wherein said shell comprising secured surface features on an exterior surface of said shell.

7. The oral pacification device of claim 6 further comprising a dentifrice applied over said surface features.

8. An oral pacification device adapted to be at least partially inserted into the oral cavity, said device comprising:

a. a bladder comprising an exterior shell and a fluid-filled chamber, the bladder forming a nipple at a posterior end and an at least first flange along an anterior end;

b. said chamber extending into said nipple and said at least first flange, a nipple interior in fluid communication with a flange interior;

c. wherein said at least first flange comprises a central indentation along a flange edge adapted to accommodate a user's frenum.

9. The oral pacification device of claim 8 wherein said shell comprising secured surface features on an exterior surface of said shell.

10. The oral pacification device of claim 9 further comprising a dentifrice applied over said surface features.

11. An oral pacification device adapted to be at least partially inserted into the oral cavity, said device comprising:

a. a bladder comprising an exterior shell and a fluid-filled chamber, the bladder forming a nipple at a posterior end and an at least first flange along an anterior end;

b. said chamber extending into said nipple and said at least first flange, a nipple interior in fluid communication with a flange interior;

c. an at least first wing along said anterior end of said exterior shell and positioned posterior relative of said at least one flange d. wherein said at least first wing is integrated within said bladder wherein at least a portion of said shell adapted to migrate from said nipple to said at least one wing when bladder transforms from a resting shape to a compressed state.

12. The oral pacification device of claim 11 wherein said shell comprising secured surface features on an exterior surface of said shell.

13. The oral pacification device of claim 12 further comprising a dentifrice applied over said surface features.

14. An oral pacification device adapted to be at least partially inserted into the oral cavity, said device comprising:

a. a bladder comprising an exterior shell and a fluid-filled chamber, the bladder forming a nipple at a posterior end and an at least first flange along an anterior end;

b. said chamber extending into said nipple and said at least first flange, a nipple interior in fluid communication with a flange interior;

c. an at least second flange, wherein said at least first flange comprises a superior flange on a superior side of said bladder, and said at least second flange comprises an inferior flange on an inferior side of said bladder, and wherein said superior flange is set anterior relative to said inferior flange; and d. an at least first wing along said anterior end of said exterior shell and positioned posterior relative of said at least one flange; wherein said at least first wing is integrated within said bladder wherein at least a portion of said shell adapted to migrate from said nipple to said at least one wing; and further comprising an at least second wing, wherein said at least first wing comprises a superior wing on said superior side of said bladder, and said at least second wing comprises an inferior wing on said inferior side of said bladder, and wherein said superior wing is set anterior relative to said inferior wing.

15. The oral pacification device of claim 14 wherein said shell comprising secured surface features on an exterior surface of said shell.

16. The oral pacification device of claim 15 further comprising a dentifrice applied over said surface features.

17. A pacifier adapted for maintenance of an oral cavity, said pacifier comprising:

a. a first separable unit comprising a lip shield with integrated bite block extending posterior of a posterior surface of said lip shield;

b. a second separable containment unit comprising a mating end and an extended nipple opposite said mating end defined by an edge, and further comprising at least one circumferential flange along an exterior of said second unit;

c. wherein said posterior surface of said lip shield is mated to said edge to join said first unit and said second unit and form a fluid-tight seal and define a chamber set within said second unit.

18. The pacifier as set forth in claim 17 wherein said chamber is filled with a fluid.

19. The pacifier as set forth in claim 18 wherein said chamber includes a continuous cavity extending into said nipple and said at least one flange.

20. The oral pacification device as set forth in claim 19 wherein said bite block is bifurcated to form a channel.

21. The pacifier as set forth in claim 20 wherein said at least first wing is hollow and in fluid communication with said chamber.

22. The oral pacification device as set forth in claim 19 wherein said circumferential flange comprises a superior indentation along a flange superior edge adapted to accommodate a user's frenum.

23. The pacifier as set forth in claim 18 wherein said fluid comprises a gas.

24. The pacifier as set forth in claim 18 wherein said fluid comprises a liquid.

25. The pacifier as set forth in claim 24 wherein said fluid comprises a freezable liquid.

26. The pacifier as set forth in claim 18 wherein said fluid comprises a gel.

27. The pacifier as set forth in claim 18 wherein said fluid comprises a gas.

28. The pacifier as set forth in claim 17 further comprising at least a first wing along said exterior, said at least first wing set posterior relative of said circumferential flange.

29. The pacifier as set forth in claim 17 wherein said mating end comprises an open end.

30. The pacifier of claim 17 wherein said circumferential flange comprising an exterior surface texture.

31. The pacifier of claim 30 further comprising a dentifrice applied over said exterior surface texture.

* * * * *